US006120554A

United States Patent [19]

Patton et al.

[11] Patent Number: 6,120,554

[45] **Date of Patent: *Sep. 19, 2000**

[54] CATALYZED ALKALINE HYDROGEN PEROXIDE BLEACHING OF DYE-CONTAINING CELLULOSE TEXTILES

[75] Inventors: Robert T. Patton, Lake Jackson; David Hall, Auburn, both of Tex.

[73] Assignee: American Renewable Resources LLC, Burlingame, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/017,064

[22] Filed: Feb. 2, 1998

[51] Int. Cl.[7] ..... D06L 3/02

[52] U.S. Cl. ..... 8/102; 8/107; 8/111; 8/138; 510/309; 510/311; 510/312; 510/320; 510/321

[58] Field of Search ..... 8/102, 107, 111, 8/138; 510/309, 911, 312, 320, 321; 435/263

[56] References Cited

U.S. PATENT DOCUMENTS

| | | | |
|---|---|---|---|
| 2,003,928 | 6/1935 | Evant et al. . | |
| 4,218,220 | 8/1980 | Kappler et al. | 8/102 |
| 4,243,391 | 1/1981 | Puchta et al. | 8/111 |
| 4,286,961 | 9/1981 | Buser et al. | 8/532 |
| 4,357,256 | 11/1982 | Yamaguchi | 252/188.24 |
| 4,378,967 | 4/1983 | Yotsuya et al. | 8/111 |
| 4,397,757 | 8/1983 | Bright et al. | 252/186.41 |
| 4,532,127 | 7/1985 | Feinland et al. | 424/62 |
| 4,614,646 | 9/1986 | Christiansen | 8/109 |
| 4,740,213 | 4/1988 | Ricci | 8/108.1 |
| 4,850,156 | 7/1989 | Bellaire | 51/293 |
| 4,961,751 | 10/1990 | Eissele et al. | 8/111 |
| 5,006,125 | 4/1991 | Patton et al. | 8/188 |
| 5,030,242 | 7/1991 | Bellaire | 8/483 |
| 5,114,426 | 5/1992 | Milora et al. | 8/102 |
| 5,215,543 | 6/1993 | Milora et al. | 8/102 |
| 5,298,027 | 3/1994 | Kuno et al. | 8/108.1 |
| 5,458,737 | 10/1995 | Diaddario, Jr. | 162/72 |
| 5,531,796 | 7/1996 | Wasinger et al. | 8/102 |

FOREIGN PATENT DOCUMENTS

WO 92/18683 10/1992 WIPO .

OTHER PUBLICATIONS

Lehninger, Principles of Biochemistry (month unknown), 1892.

*Primary Examiner*—Alan Diamond
*Attorney, Agent, or Firm*—David J. Brezner; Flehr Hohbach Test Albritton & Herbert LLP

[57] ABSTRACT

A process for decolorizing a cellulose textile bearing oxidized vat dye comprising contacting the cellulose textile with an aqueous solution of hydrogen peroxide containing an amount of a hydrogen peroxide catalyst sufficient to oxidize vat dye in the fabric until the dye is decolorized by oxidation. Then the cellulose textile is separated from the aqueous solution. The hydrogen peroxide catalyst can be a water-soluble lower alkyl quaternary amine salt such as a dihydroxypropyltrimethylammonium halide, chlorohydroxypropyltrimethylammonium halide or epoxypropyltrimethylammonium halide, or it can be a transition metal ion such as a cupric or stannous metal ion present in an amount of from 0.1 to 2 ppm. The process is suitable for decolorizing denim bearing vat dyes such as indigo, and is particularly suitable for decolorizing denim scrap.

11 Claims, 4 Drawing Sheets

CATALYZED ALKALINE HYDROGEN PEROXIDE BLEACHING OF DYE-CONTAINING CELLULOSE TEXTILES

FIELD OF THE INVENTION

This invention relates to a process for bleaching cellulose textiles such as cotton. In particular, the process of this invention is directed to bleaching residual bleach-resistant vat dyes on scrap textiles such as denim scrap where the vat dyes have been applied in a reduced, soluble form and oxidized to precipitate the dye in and on the fabric in an insoluble form.

BACKGROUND OF THE INVENTION

Cotton and other cellulose scraps produced when cutting cotton fabrics during clothing manufacture are a waste product typically buried in landfills or consumed in incinerators. Garnetting or other maceration techniques to separate and recover the cotton fibers from the scraps shortens the fiber lengths, and the resulting products have few end uses. As a consequence, over 200 million pounds of denim scrap alone is destroyed as waste each year.

U.S. Pat. Nos. 5,376,143 and 5,471,720 describe a process for recycling denim waste by separating the fibers, preparing a colored yarn of a blend of the recycled fibers and virgin fibers, and preparing denim or similarly dyed fabric from the yarn. This process has not been commercially implemented, perhaps because of costs of fiber separation and the limitations of the shortened fibers in making a strong, durable fabric.

Many applications of cotton, however, do not require long fibers. Cotton batting is a popular absorbent because of its softness and cushioning characteristics and high water absorbency. It is a preferred component for many industrial and household products, such as quilts, upholstery, sanitary napkins and diapers, and medical products such as swabs, bandages and the like. However, most of these applications require that the cotton fibers be purified, colorless, and strong, and a process for recycling cotton scrap to produce cotton fibers for these applications has not been commercially feasible because of the difficulties in processing the scrap. One principal area of difficulty is removal and/or decolorizing of the vat dyes present in many cotton scraps such as denim.

Vat dyes consist of solubilized colored compounds which are usefully precipitated as the insoluble form within cellulosic fibers. These compounds are reversibly changed to a water-soluble "leuco" state by chemically reducing them in an alkaline reduction process. This is done easily by mixing the dye into a water solution containing a water-soluble reducing agent such as alkaline sodium hydrosulfite. In a dying process, the cellulosic fiber is typically immersed in a bath containing such a reduced leuco solution, and the dye is allowed to penetrate the substrate.

After this immersion, the fiber is exposed to an oxidizing environment. Such an environment is air and, in one such process, the yarn, wetted in a leuco solution, is draped in long beams over rolls and exposed to air until the dye and accompanying reducing agents are oxidized. Dilute hydrogen peroxide or another peroxygen compound can also used for this oxidation. In each case, the oxidized medium converts the leuco dye into its original water-insoluble state. If the dye molecule is contained within the cellulose substrate, the water-insoluble dye is trapped and cannot be removed by casual exposure to water and detergents.

Fabric is often dyed with more than one leuco dye. It common practice to dye dark shades of indigo first with the leuco form of a black sulfur dye and second with the leuco form of blue indigo dye. Both dyes require subsequent oxidation to render them water-insoluble.

Since the vat dyeing process involves oxidation to the leuco state to form the insoluble oxidation product, vat dyes are chosen to be resistant to the action of bleaching oxidants. Vat-dyed cellulose textiles must be stable in the presence of hydrogen peroxide and are resistant to hydrogen peroxide oxidation to a colorless or bleached state. Bleaching oxidation of vat-dyed cellulose textiles has therefore required the application of stronger oxidants such as sodium hypochlorite, for example, which also attack and weaken the fibers under the harsh conditions required to achieve complete decolorization. The halide bleaches also create serious environmental problems in the volumes required for commercial applications.

A portion of the vat dyes can be removed and the dyes recovered by the reducing process described in U.S. Pat. No. 5,366,510, for example, the contents of which is hereby incorporated by reference. Removal and recovery of vat dyes from denim fabric scraps is advantageous in the recycling process. However, only a portion of the dye can be removed by this process, and a process is needed which can remove or eliminate the residual coloring in the product without significantly reducing the strength and other properties of the cellulose fibers.

As will be more evident from the description of the invention hereinafter, this invention is based on a discovery that catalyzed hydrogen peroxide bleaching processes which have heretofore been applied to bleaching paper pulp are sufficiently strong to overcome the hydrogen peroxide oxidation resistance of the dyes and to effectively remove and eliminate vat dye coloring from cellulosic textiles and textile scraps. But, in contrast to the strong bleaches, the process does not cause significant change to the strength or other qualities of the cellulose fibers. The process furthermore has the advantage of being environmentally safe. Obviously, other oxidation-resistant dyes from other dye classes would benefit from this process.

SUMMARY OF THE INVENTION

One object of this invention is to complete decolorizing vat-dyed cellulosic textile textiles and textile scraps without significantly weakening the cellulose fibers therein.

Another object of this invention is to decolorize residual vat dyes remaining in denim scraps after removal of most of the indigo dyes therefrom by reductive solubilization of the dye and extraction of the dye.

In summary, one aspect of this invention is a process for decolorizing a cellulose textile bearing oxidized vat dye. It should be readily understood to a person skilled in the art that the process will also be suitable for oxidation-resistant dyes other than vat dyes derived from other dye classes and these are intended to be included within the scope of this invention.

The process comprises contacting the cellulose textile with an aqueous solution of hydrogen peroxide containing an amount of a hydrogen peroxide catalyst sufficient to oxidize dye in the fabric until said dye is decolorized by oxidation. Then, the cellulose textile is separated from the aqueous solution. The dye should be capable of being decolorized by oxidation, the dye can be an oxidation resistant dye.

The hydrogen peroxide catalyst can be a water-soluble lower alkyl quaternary amine salt such as a hydroxy, chlorhydrin or epoxy substituted lower alkyl trimethylamine salt, preferably present in an amount of from 500 to 1500 ppm. The substituted quaternary amine salt is optimally one or more members selected from the group consisting of a dihydroxypropyltrimethylammonium halide, chlorohydroxypropyltrimethylammonium halide and epoxypropyltrimethylammonium halide.

Alternatively, the hydrogen peroxide catalyst can be a transition metal ion. Preferred transition metal ions are cupric and stannous metal ions present, for example, in an amount of from 0.1 to 2 ppm.

In one embodiment, the textile fabric in step (a) has been treated with a reducing agent to solubilize and remove most of the vat dye therefrom. Optimally, the reducing agent treatment also removes size from the fabric.

The process of this invention can be used in decolorizing any cellulose textile or fabric made of other materials, but it is particularly suitable for decolorizing denim bearing an insoluble indigo dye. The process is uniquely suitable for decolorizing denim scrap.

DETAILED DESCRIPTION OF THE INVENTION

Figure 1:
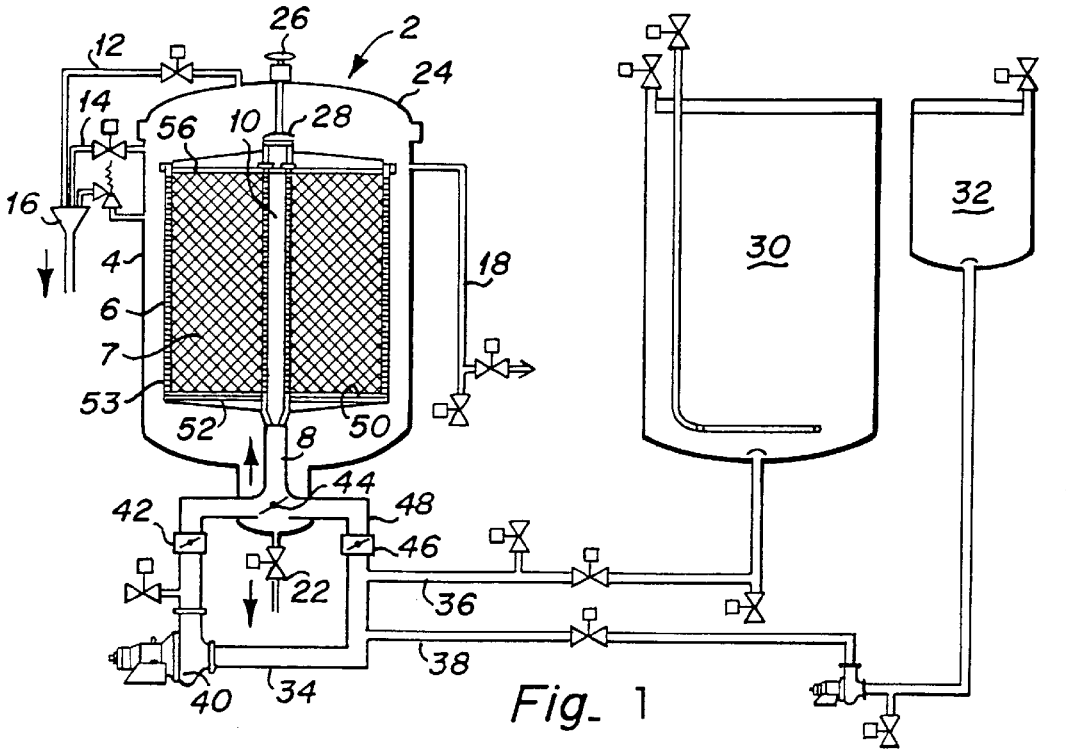
FIG. 1 is a cross-sectional representation of a forced circulation kier suitable for use in the process of this invention.

The process of this invention is described hereinafter in terms of bleaching denim scrap because it is more demanding and requires description of more details than bleaching of dyed unfinished and finished cellulose fiber products such as clothing. Dye removal and bleaching of denim garments is desired to produce products having a faded "stone-washed" appearance, for example. It will be readily understood to a person skilled in the art that the process of this invention can be applied to remove all or only a portion of the color in a dyed fabric or garment of cellulose or other material and all of these bleaching applications are intended to be included within the scope of the invention.

The processing of fabric scrap according to this invention includes the steps of scrap preparation, dye removal, and bleaching to remove or decolorize any residual dye present in the fabric to yield a completely white, decolorized material. This invention is based on the discovery that, with the appropriate catalysts, hydrogen peroxide can effectively decolorize dyes which have been selected to be oxidation-resistant, even dyes which are routinely insolubilized with hydrogen peroxide without loss of color. And, even more surprisingly, very satisfactory decolorizing is obtained without significant loss of fiber strength or fiber quality.

Subsequent steps in the process may include treating the decolorized denim fabric with various chemical reagents which may assist in optimizing the fabrics of the invention for utilization in subsequent processes or end use applications. Thus, the chemical reagents may include humectants, antibacterial agents, enzymes, antimicrobial agents, mildewcides, lubricants, dyes, tints, optical brighteners, stain resistant agents, delustrants, deodorants, flame retardants, water repellents, perfumes, hand modifiers, softeners, antistatic agents, and combinations thereof. An operation typical of a subsequent process could include garnetting or similar maceration operations to separate the fibers from the decolorized fabric.

Scrap typically has irregular shapes and sizes. For uniform processing, cutting the fabric pieces to have a maximum length and width of less than 4 inches and preferably about 2 inches in its longest dimension is desirable. The scraps can be cut or chopped into pieces of this size using conventional fabric chopping equipment.

Because of the size and construction of the pieces of denim scrap, it is difficult to accomplish uniform processing in the bath processes for dye removal and bleaching. Denim is a twill fabric and hence does not have a symmetrical weave. On one side of the fabric, more warp yarn is exposed than fill yarn and, on the other side, more fill yarn is exposed than warp yarn. In indigo-dyed denim, the warp yarn is heavily dyed, and the fill yarn is undyed. Because of the asymmetry in construction and the different chemical history of the yarns, when denim scraps are wetted and agitated in a free state, they curl and roll into spirals of fabric, sometimes tightly. A tightly wound spiral allows poor access to a circulating bath, since the inner portions of the spiral are shielded by the outer layers. As a further problem, highly agitated baths tend to unravel the scraps, producing useless balls and tangles of yarn and fabric scraps which can foul the bath or equipment components.

This problem is avoided by use of a forced circulation kier or trench method, as described in detail below.

Forced Circulation Kier Method

Figure 2:
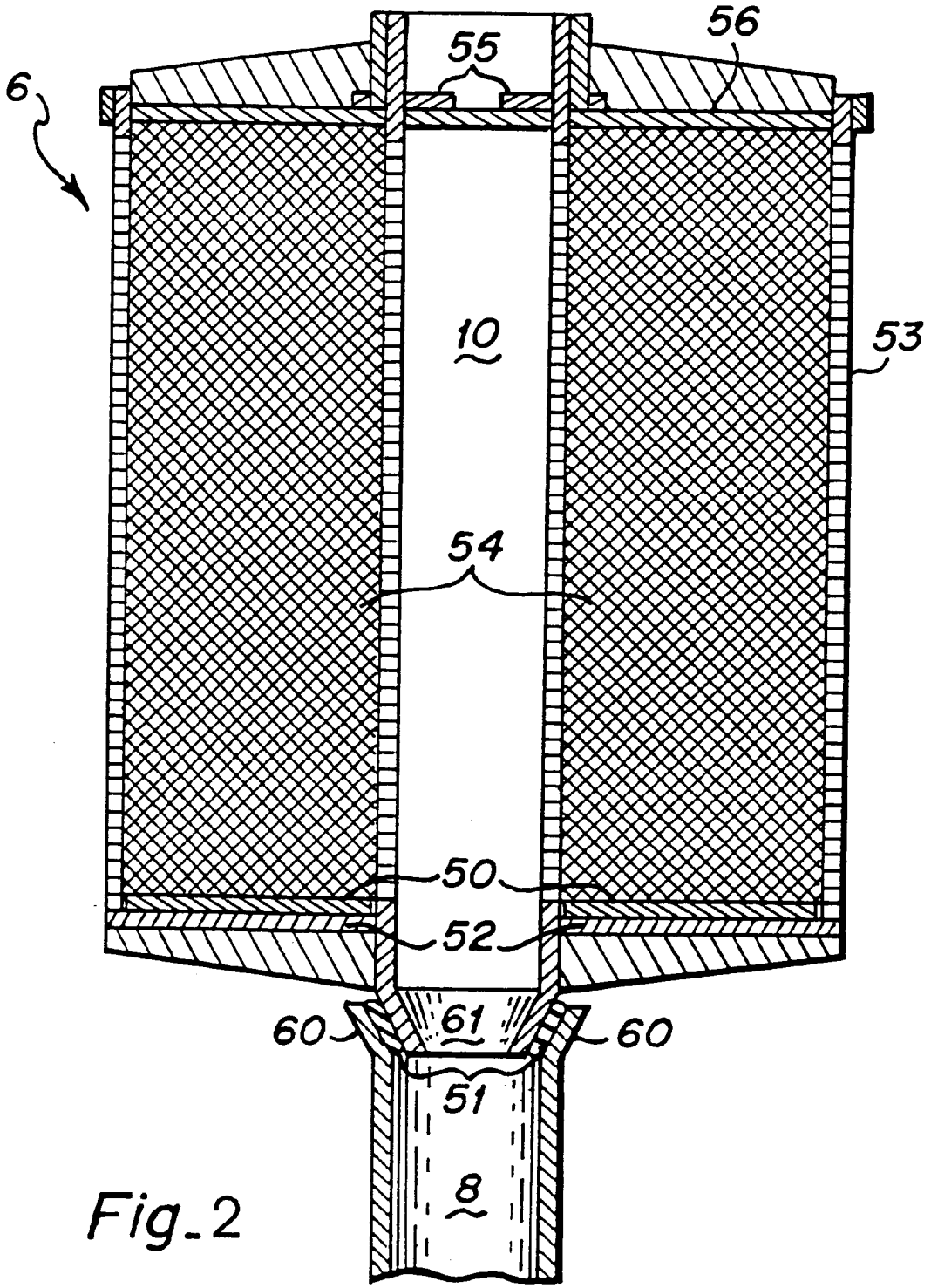
FIG. 2 is a schematic cross-sectional view showing the structure of the treatment section of the vessel shown in FIG. 1.

FIG. 1 is a cross-sectional representation of a forced circulation kier suitable for use in the process of this invention and FIG. 2 is a schematic cross-sectional view showing the structure of the treatment section of the vessel shown in FIG. 1.

The kier 2 comprises a closed vessel 4 housing the liquid treatment basket 6 containing fabric bed 7. Treatment liquid is introduced into the bottom of the treatment basket 6 through pipe 8, passes upward through the perforated distributor 10, passes through the bed 7, and then returns to the pump 40 through pipe 48. The treatment vessel is equipped with valved outlet conduits 12 and 14 leading to the drain 16 and sampling line 18. The vessel is also equipped with conventional heating and cooling coils through which steam or cooling water is passed in order to change the temperature of the contents as desired. Vessel drain line 22 is provided to remove liquid contents during cleaning.

The vessel has a quick closing flanged top lid closure 24 (details not shown), which is sealed into place when the vessel is loaded with denim scrap. After closure, valve wheel 26 is turned to close the end 28 of the distributor and press the basket assembly distribution pipe or sparger 10 down against the gasket 51 (FIG. 3) in the flared supply pipe 8.

Treatment liquids can be prepared in vessels 30 and 32. For processes using reagents which are to be mixed immediately prior to use, the individual reagent solutions are introduced into the supply conduit 34 through conduits 36 and 38 from the respective tanks 30 and 32, where they are mixed as they pass through the pump 40, valves 42 and 44, and into the inlet conduit 8. The disk in valve 44 can be rotated 90° to reverse the direction of liquid flow so that flow penetrates the bed 7 from the outside and returns to the pump 40 through perforated sparger 10 and then pipe 48.

Valve 46 in the return line 48 is usually opened to permit recirculation of liquids through the inlet pump 40.

Details of the treatment basket 6 are shown in FIG. 2. This basket 6 consists of a perforated cylindrical distributor or sparger 10, perforated cylindrical shell 53, a stayed flat bottom 52, and a stayed lid 56. The entire basket assembly sits on a flared extension 60 of the supply pipe 8 with an elastomeric gasket 51 sandwiched between the tapered bottom 61 of the basket sparger 10 and the flared top 60 of the supply pipe 8.

Supported on the top of the stayed basket bottom 52 is a separator plate 50. The separator plate 50 supports the compressed bed of chopped fabric scrap 54. The stayed lid 56 is positioned at the top of the basket assembly 6.

For a preliminary compression step during the fabric loading, the stayed lid 56 is temporarily attached to a hydraulic ram (not shown). The lid 56 is pressed toward the bottom plate 50 to densify the scrap pieces and force them into a void free mass, most of the scraps having the horizontal orientation necessary for uniform fluid circulation between layers. After completing the hydraulic compression stroke, the lid 56 is secured to the standpipe 10 by means of latches 55. Alternatively, the lid 56 can be secured to the basket shell 53 with similar latches (not shown). Once the latches 55 are engaged, the lid 56 is disengaged from the hydraulic ram, and the loaded basket is ready for fabric dye extraction and bleaching. Once the bleaching process is complete, the lid 56 is unlatched and removed, and the compressed fabric cake 54 is removed from the basket 6 by lifting the separator plate 50. The separator plate 50 be provided with chains (not shown) attached at several points around the perimeter of the plate to permit the plate and fabric cake to be lifted from the basket. Alternatively, the system can be provided with a plurality of rams (not shown) passing upward through holes in the stayed plate 52 to raise the separator plate 50 and the fabric cake 54 to the top of the treatment vessel.

Figure 3:
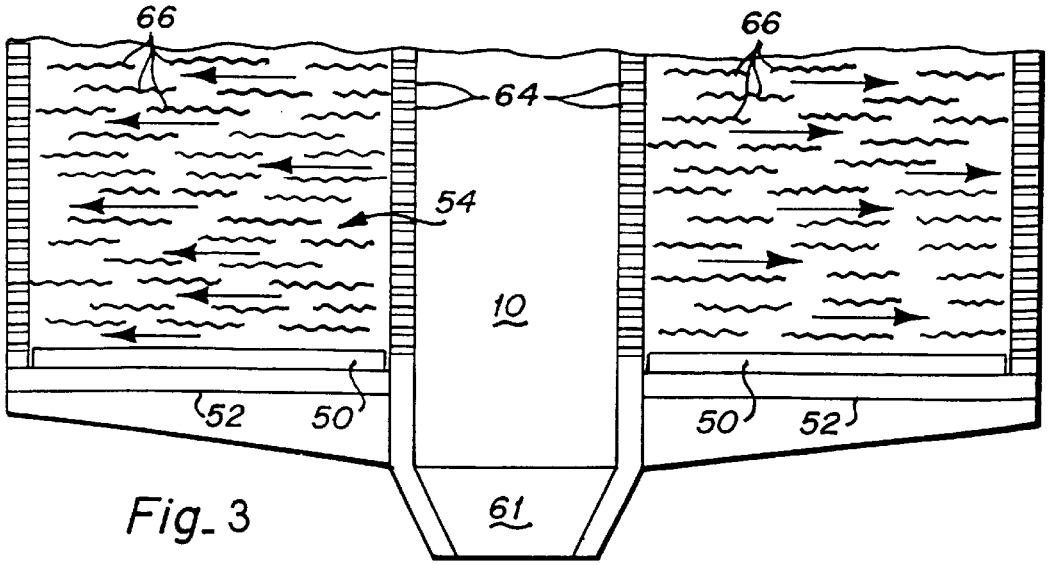
FIG. 3 is a schematic view of layered denim scraps in the treatment section shown in FIG. 2, showing the flow of treatment liquids between the fabric layers to achieve uniform exposure of the fabric surfaces to the treating liquids.

FIG. 3 is a schematic view of layered denim scraps in the treatment section shown in FIG. 2, showing the flow of treatment liquids between the fabric layers to achieve uniform exposure of the fabric surfaces to the treatment liquids. Liquid passing upward through supply conduit 8 passes upward into the perforated distributor 10, which, after closure of the vessel, has a closed outlet. The pressure of the liquid forces it outward through the perforations 64 and through the fabric layers, passing radially outward between opposed surfaces of the fabric pieces 66 and contacting all surfaces uniformly for extraction and/or oxidation of the dye in the fabric.

Referring to FIG. 1, the liquid passes outward through the fabric cake and into space which is present between the treatment section 6 and the wall of vessel 4 and passes downward until it returns to the pump 40 through pipe 48.

In the forced circulation kier process, the dry fabric scraps are deposited in flat layers on bottom plate 50 to form a thick deposit of several feet of fabric around the center liquid distributor 10 to be used for introducing process liquid. The liquid distributor can be a perforated pipe, for example, connected to a pressure pump and process liquid source. The top plate 56 presses against the top surface layer of the fabric, compressing the fabric into a dense cake. A kier basket having a diameter of 1500 mm and a central distributor pipe diameter of 500 mm and filled to a compressed depth of 2025 mm would contain about 1400 kg of dry scrap and yield a wet cake weighing about 3500 kg.

Process liquid is forced outward through the dense layers of fabric from the center distributor. The compressed layers maintain the scraps in a flat, laminated relationship, and the liquid passes under pressure from the center distributor radially outward between adjacent scrap surfaces, contacting all of the fabric surfaces and exposing the dyes in the fabric to the processing chemicals in a uniform treatment. The cake configuration prevents curling of the scrap and maintains it in a flat, laminar orientation in the process cake.

A series of process liquids are passed through the kier cake to remove size, to reduce and remove dye for recovery, and to decolorize the fabric by bleaching. The fabric can be simultaneously desized and a larger portion of the dye removed by applying the process described in U.S. Pat. No. 5,266,510. Reducing agents which can simultaneous remove size and reduce dye to a soluble form for removal include alkali metal hydrosulfites, sulfides, thiosulfates, oxalates, hydrosulfites and sulfides, and thiourea dioxide. Of the preferred reducing agents, alkali metal and zinc sulfoxylate formaldehydes are used in acidic and basic conditions, and sodium hydrosulfite and sodium sulfide require basic conditions.

If dye recovery is not an objective of the dye removal process, the addition of a dye complexing agent such as polyvinyl pyrrolidone to the process solution to prevent redeposition of the dye is advantageous.

After removing the reducing solutions and rinsing with water containing polyvinyl pyrrolidone to remove any remaining free-floating dye, a catalyzed hydrogen peroxide bleaching solution is passed through between the scrap surfaces according to the process of this invention.

The hydrogen peroxide bleaching solution should have a concentration of hydrogen peroxide of from 0.2% to 3.0%. The concentration range is preferably from 0.25% to 1.0%. The solution pH is preferably within the range of from 10.5 to 11.0, and the process water temperature is preferably within the range of from 75° C. to 150° C., most preferably, from 100° C. to 130° C. The addition of catalyst demands that the pH be maintained somewhat lower than without catalyst, for example, 10.5 with catalyst and 10.8 without catalyst. The use of higher temperatures accelerates the bleaching regardless of catalyst and improves the whiteness achieved.

Suitable catalysts include transition metal ions, preferably cupric and stannic ions. Other transition metal ions such as chromium, cobalt and nickel also exhibit catalyst activity. The concentration of catalyst must be sufficient to catalyze the bleaching reaction, but should be insufficient to cause spontaneous and rapid decomposition of the hydrogen peroxide. A transition metal ion catalyst concentration of from 0.1 to 2 ppm is usually operable, and a concentration of from 0.3 to 0.7 ppm is preferred. Careful control of catalyst concentration is required.

Because these metal ion catalysts cause decomposition of the hydrogen peroxide at higher concentrations, quantities of transition metal ions normally present in conventional water can cause serious problems. Removal of these ions by ion exchange is usually necessary prior to the addition of the desired level of catalyst.

Of course, the chelating agent can also complex and deactivate the desired metal catalysts, and the amount of chelating agent must be carefully titrated to complex all of the contaminants and avoid a significant surplus over the amount required for this purpose. Obviously, constant testing and titrating the chelating agent requirements are necessary if the amounts of contaminants in the water are highly variable.

Water-soluble quaternary amines are preferred catalysts because they are not significantly complexed and deactivated by conventional chelating agents. Suitable water-soluble quaternary amines include lower alkyl ammonium halides and their derivatives such as hydroxy, chlorhydrin and epoxy substituted lower alkyl trimethylammonium halides such as substituted propyltrimethylammonium chlorides. Preferred quaternary amines for use in the process of this invention are dihydroxypropyltrimethylammonium chloride, chlorohydroxypropyltrimethylammonium chloride, and epoxypropyl-trimethylammonium chloride, for example, with the dihydroxy compounds being most preferred. Preferred examples of the above compounds include 3-chloro-2-hydroxypropyl trimethyl ammonium chloride, 2,3-epoxypropyl trimethyl ammonium chloride, 3-chloro-2-hydroxypropyl trimethyl ammonium chloride, and 2,3-dihydroxypropyltrimethyl ammonium chloride.

These quaternary amine catalysts have been used to catalyze hydrogen peroxide bleaching of wood pulp. Wood pulp cellulose pigments are not selectively resistant to hydrogen peroxide, and the unique action of catalyzed hydrogen peroxide on vat dyes would not be predicted or suggested by their action in wood pulp.

The concentration of the quaternary amine catalyst in the hydrogen peroxide solution should be from 0.1% to 10% (w/w%); preferably, from 0.1% to 1%; more preferably, from 0.1% to 0.8%; most preferably, from 0.1% to 0.5%.

Following the hydrogen peroxide bleaching, rinse water is passed through the scrap laminae to remove residual bleach and catalyst. At this point, it may be desirable to add various chemical reagents that may assist in optimizing the fabrics of the invention for utilization in subsequent processes or end use applications. Thus, the chemical reagent may include but is not limited to humectants, antibacterial agents, lubricants, dyes, tints, optical brighteners, hand modifiers, antistatic agents, and combinations thereof.

The scrap cake is removed from the basket and spun to reduce the water content, broken up into individual scrap fragments, and the fragments are dried.

Trench Method

Figure 4:
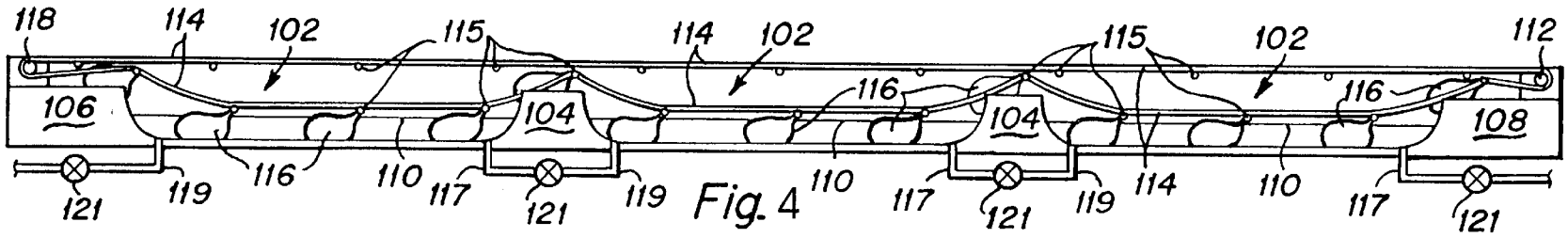
FIG. 4 is a schematic longitudinal cross-sectional view of an abbreviated trench processing system suitable for use in the process of this invention.
Figure 5:
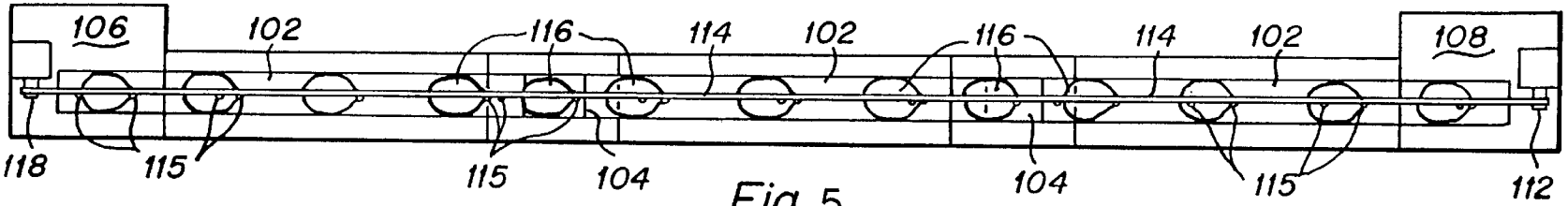
FIG. 5 is a top view of the trench processing system of FIG. 4.

FIG. 4 is a schematic longitudinal cross-sectional view of an abbreviated trench processing system suitable for use in the process of this invention, and FIG. 5 is a top view thereof. The trench system is a series of longitudinal elongated vats 102 optionally separated by raised drain platforms 104 with an untreated bag support platform 106 at the staging end and a processed bag support platform 108 at the receiving end. A drum pulley 112 driven by a motor mounted on platform 108 reels in the endless loop of draw rope or cable 114. The draw rope 114 has rings 115 attached to it for shackling to bags filled with scrap 116, as shown in greater detail in FIG. 9. A matching drum pulley 118 supported on platform 106 reels and returns the draw rope 114 to the staging platform 106 for attachment of bags of scrap awaiting processing. The bags 116 are drawn through treatment liquid 110 in each vat.

Each vat has a liquid inlet pipe 117 and an outlet pipe 119, the outlet pipe from one vat being connected with a valve 121 to the inlet pipe of the adjacent vat for movement of liquid through the series of vats in a direction counter to the direction of movement of the bags 116. The vats can have bottoms at the same elevation or they can have progressively lower elevations in the direction of the liquid flow in order to use gravity to move the liquid between vats. Similarly, the bottom of each vat can be level or sloped slightly upward in the direction of bag movement to facilitate liquid flow in the countercurrent direction.

Figure 6:
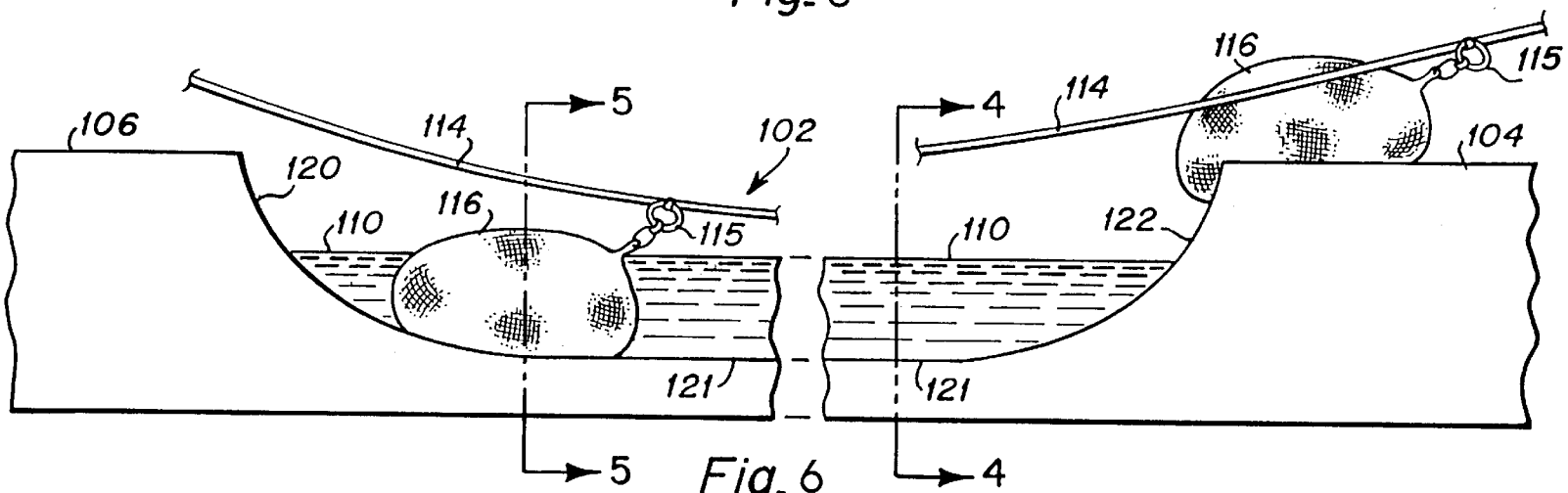
FIG. 6 is a cross-sectional view of a section of the trench processing system of FIG. 4.

FIG. 6 is a cross-sectional view of a section of the trench processing system of FIG. 4. Each treatment vat 102 has a sloped inlet end 120, down which each bag is drawn into the treatment liquid, a flat bottom 121, and a sloped outlet end 122, up which each bag is drawn to a draining platform 104.

Figure 7:
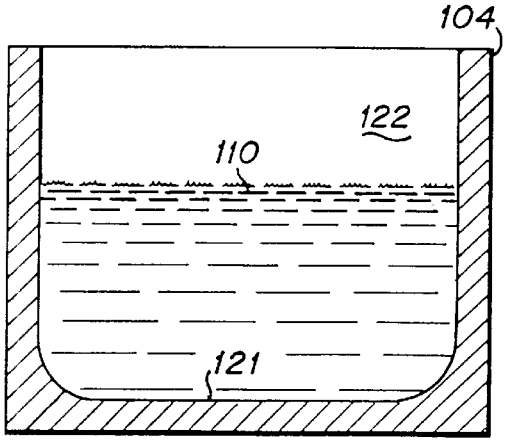
FIG. 7 is a cross-sectional view of the trench taken along the line 4—4 in FIG. 6.
Figure 8:
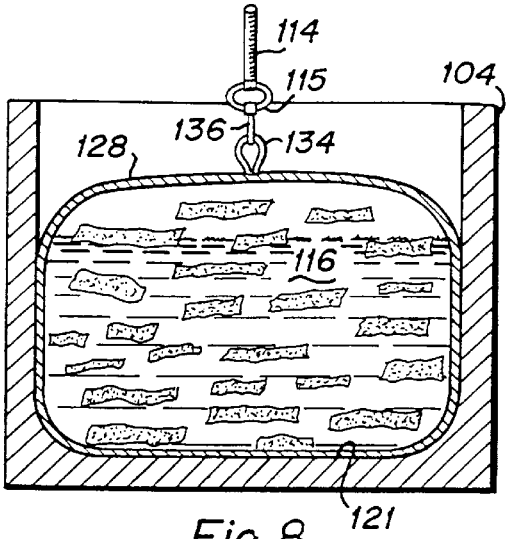
FIG. 8 is a cross-sectional view of the trench and fabric treatment bag taken along the line 5—5 in FIG. 6.

FIG. 7 is a cross-sectional view of the trench taken along the line 4—4 in FIG. 6, and FIG. 8 is a cross-sectional view of the trench and fabric treatment bag taken along the line 5—5 in FIG. 6. The bottom of the vat has a curved shape to which the bags conform. The treatment liquid level 110 is lower than the top 128 of the bag so the bag acts as a plug, forcing the liquid to flow through the contents of each bag as the bag is drawn through the vat.

Figure 9:
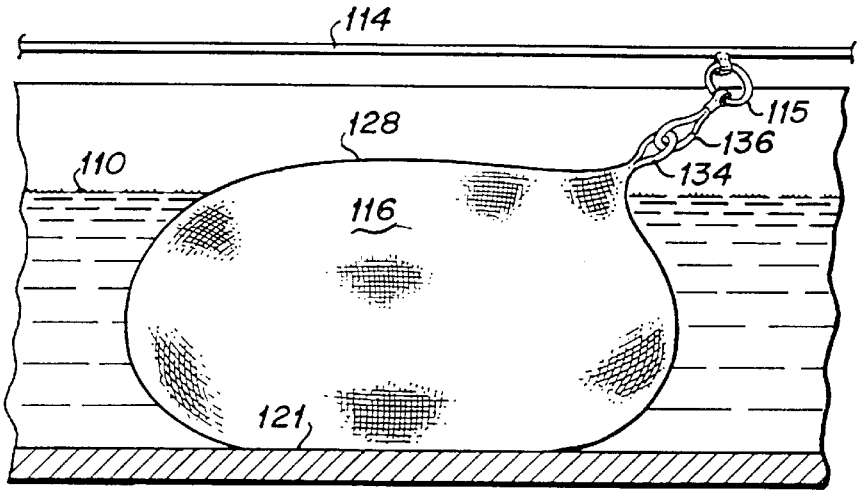
FIG. 9 is a view of a typical scrap bag 116.

FIG. 9 is a view of a typical bag 116. The bags have a conventional open mesh construction, sufficiently tightly woven so as to retain the fabric scraps, but not so tightly woven as to impede liquid flow. Each bag has a loop 134 which is attached by a shackle 136 to a ring 115 fixed to a draw rope 114.

Referring to FIGS. 4 and 5, after the denim scrap is placed in the mesh bag 116, the bag is placed on the untreated fabric platform 106 and shackled to the draw rope 114. The draw rope 114 pulls the filled bag slowly into the first vat 102 where it is thoroughly wetted by the treatment liquid 110. The bag plugs the vat and extends above the top surface of the liquid 110. As the slow bag movement continues, the bag is very slowly drawn through the vat, liquid is pushed down the vat by the bag, raising the liquid level in front of the bag, whereby the difference in liquid level causes the liquid to flow by gravity through the contents of the bag. As the bag movement continues, the bag is drawn up onto platform 104, above the liquid level, and the excess liquid drains from the bag. The bag is then drawn into the next vat of the series where the process is repeated until the bag is drawn from the final vat onto the treated fabric platform 108.

The treatment liquid flows through the series of vats in a direction counter to the direction of movement of the fabric-filled bags, fresh liquid being introduced at the end of the last vat adjacent the treated fabric platform 108 to effect final treatment of the fabric with fresh liquid. The liquid is passed from vat to vat through the conduits 119 and 117 until it is removed from the vat system adjacent the untreated fabric platform 106. In this manner, for dye removal by an organic solvent or an aqueous reducing solution, the liquid removed from the system has the maximum concentration of dye, facilitating dye recovery, and the fabric from which the dye has been completely removed has a final exposure to clean solvent or reducing solution. Similarly, for bleaching, the fabric at the end of the process is exposed to a maximum strength bleaching solution, while the fabric first being introduced to the system with the maximum amount of dye is exposed to a bleaching solution which can be almost exhausted, if desired, to a maximum efficiency for bleaching with the chemical bleaching reagent.

It will be readily apparent to a person skilled in the art that any number of vats can be used, and special pretreatment vats and final rinsing vats can be interposed with separate liquid supplies and waste lines, if the process requires these additional steps. The vats can be provided with conventional heating coils to maintain the vat solutions at a preselected elevated temperature, if desired.

After removal of the reducing solutions and rinsing with water containing polyvinyl pyrrolidone to remove any remaining free dye, the bags 116 can be placed into a second series of vats having the structure shown in FIGS. 4 and 5 where they are drawn through a catalyzed hydrogen peroxide bleaching solution. It will be readily apparent to a person skilled in the art that the rinse treatment and the catalyzed hydrogen peroxide bleaching solutions can be provided in an extension of the dye removal vats or in a separate series having the same or a similar structure, and all configurations of vats and treatment solutions are intended to be included within the scope of this invention.

Preferred hydrogen peroxide concentrations and suitable catalysts and chelating agents for use in the process of the invention are discussed in the above section.

Following the hydrogen peroxide bleaching, rinse water is passed through the scrap laminae to remove residual bleach and catalyst. At this point, it may be desirable to add various chemical reagents that may assist in optimizing the fabrics of the invention for utilization in subsequent processes or end use applications. Thus, the chemical reagent may include but is not limited to humectants, antibacterial agents, lubricants, dyes, tints, optical brighteners, hand modifiers, antistatic agents, and combinations thereof.

After completion of the bleaching process, the bags are removed from the final solution and spun in a centrifugal extractor to reduce the water content. The bags are then emptied and the scrap fragments are dried in a conventional drier.

Dried fabric fragments are passed through a conventional garnetting or tearing machine or similar device to separate the individual bleached cotton fibers. Subsequent processing will be determined by the desired use of the fibers. For production of yarn, the fibers are preferably blended with longer virgin fibers, carded and spun into yarn using conventional procedures. For medical cotton applications, the fibers are processed according to the traditional manufacturing procedure developed for each use.

The process of this invention is further shown by the following specific but non-limiting examples.

EXAMPLE 1

A Thies laboratory kier was loaded with 8.14 kg of sized dark blue (sulfur black bottom-dyed and indigo blue-dyed) denim cutting room scrap fabric pieces compressed to a density of 440 grams per liter. This device had a basket 230 mm in diameter and 445 mm long, having a volume of 18.5 liters. It required 57 kg of water to fill the kier. Circulation was started through the fabric at a rate of 20 liters per minute per kilogram of fabric, and the temperature of the bath was set at 80° C.

Immediately, 740 ml of 38° Baumé sodium hydroxide solution, 170 g of 95% sodium hydrosulfite powder, 57 g of Setamol WS (dye dispersant, BASF), and 57 g of Dekol SN (dye dispersant and water sequestrant, BASF) were added to the kier. Circulation was maintained for 7 minutes and the bath was dropped. The kier was immediately refilled with 80° C. water and the same chemicals in the same quantity were again added. This was repeated four times at 7-minute intervals, then 80° C. rinse water was added to the kier, circulated for 7 minutes, and then the bath was dropped. This rinse procedure was repeated three times. At this point, the fabric was a very light shade of blue.

The kier was then filled with 57 liters of 50° C. water, then 71 ml of Delimol 9208 (dye dispersant and water sequestrant), 171 ml of Delimol NSR (wetting and scouring agent, BASF), 285 ml of 20% dihydroxypropyltrimethylammonium chloride solution, and 285 ml of 38° Baumé sodium hydroxide solution were added to the bath. The bath was circulated for 5 minutes at 50° C. and 428 ml of 35% hydrogen peroxide was added. The bath was heated at 5° C. per minute to 90° C., and then 2° C. per minute to 130° C. The bath was circulated for 5 minutes and then dropped. The kier was refilled with 80° C. water, circulated for 7 minutes, and then dropped. The kier was refilled with 70° C. water and 57 ml of 60% acetic acid. This bath was circulated for 10 minutes and then dropped.

The basket was then transferred to a forced circulation pressure dryer and dried for 45 minutes. When removed from the basket, the fabric had a CIE brightness of 85 and yielded fiber with good tensile strength.

EXAMPLE 2

Catalyzed Hydrogen Peroxide Bleaching

A Morton kier with a single-stock basket was loaded with 600 pounds of dark blue sized denim cutting room scrap, which had been chopped into pieces ideally no longer than 2.5 inches in any dimension. When the basket was loaded, the scrap material was compressed to an apparent density (dry basis) of 32 pounds per cubic foot. The kier was filled with approximately 400 gallons of water at 180° F. Circulation was started through the fabric at a rate of 2.75 gallons per minute per pound of stock in a direction from the center standpipe outwards.

Bath components were added as follows: 60 pounds of 50% sodium hydroxide, 4.75 pounds of Amwet PTH wetter solution, and 8.34 pounds of dry sodium hydrosulfite. The kier was circulated for 15 minutes and then the bath was dropped.

The kier was again filled with 180° F. water and bath components were added as follows: 60 pounds of 50% sodium hydroxide, 3.34 pounds of sodium hydrosulfite, and 2.36 pounds of Amwet PTH wetter solution. The kier was circulated for 15 minutes and then the bath was dropped. The same bath was made up and circulated for 15 minutes, then dropped twice more. At this point, the extracted fabric was inspected and found to be light blue, indicating that most of the indigo had been stripped from the cotton fiber.

The kier was then filled with 100° F. water, circulated for 10 minutes, after which the bath was dropped. The rinse procedure was repeated once and then the peroxide bleach bath was introduced. To prepare the bleach bath, the kier was first filled with 400 gallons of water at 100° F. Then 10.1 pounds of Amlight PBC bleach stabilizer (American Emulsions, Inc.), 6 pounds of prepared quaternary ammonium catalyst solution, and enough caustic soda to provide a bath pH of 10.7 were added.

The catalyst had been prepared as follows: First, 30 pounds of water was put into a 5-gallon pail, then 7.55 pounds of 65% 3-chloro-2-hydroxypropyl trimethyl ammonium chloride (e.g., Amdye PTC, American Emulsions, Inc.) was stirred into the water. After this was well-mixed, 3 pounds of 50% caustic soda was mixed into the pail. Then, additional water was added to the pail until it contained exactly 5 gallons of liquid. The solution was mixed and allowed to sit for one hour.

Once the bleach bath components were added to the kier, the bath was heated at a rate of 15° F. per minute to a temperature of 230° F. The bath was held at temperature for 15 minutes, then cooled to 180° F., and then dropped. The bleach bath was followed with two rinses: The first 10-minute rinse consisted of water and 6.67 pounds of glacial acetic acid at 140° F. The second rinse bath was dropped and the stock basket was removed for drying. An inspection of the fabric showed that it had been bleached to a brilliant white.

Obviously, numerous modifications and variations of the present invention are possible in light of the above teachings. It is therefore to be understood that, within the scope of the appended claims, the invention may be practiced otherwise than as specifically described herein.

What is claimed is:

1. A process for decolorizing a cellulose textile bearing oxidized vat dye comprising the steps of a) contacting the cellulose textile with an aqueous solution of hydrogen peroxide containing an amount of a hydrogen peroxide catalyst comprising a water-soluble lower alkyl quaternary amine salt, sufficient to oxidize vat dye in the fabric until said dye is decolorized by oxidation; and b) separating the cellulose textile from the aqueous solution.

2. The process of claim 1 wherein the lower alkyl quaternary amine salt is a hydroxy, chlorhydrin or epoxy substituted lower alkyl trimethylamine salt present in an amount of from 500 to 1500 ppm.

3. The process of claim 2 wherein the substituted lower alkyl trimethylamine salt is one or more members selected from the group consisting of dihydroxypropyltrimethylammonium halide, chlorohydroxypropyltrimethylammonium halide and epoxypropyltrimethylammonium halide.

4. The process of claim 1 wherein the aqueous solution contains a chelating agent in an amount sufficient to complex multivalent metal cation contaminants in the solution.

5. The process of claim 1 wherein the cellulose textile in step (a) has been treated with a reducing agent to solubilize and remove vat dye therefrom.

6. The process of claim 5 wherein the reducing agent removes size from the fabric.

7. The process of claim 1 wherein the cellulose textile is denim bearing an insoluble indigo dye.

8. The process of claim 1 wherein the cellulose textile is denim scrap.

9. The process of claim 1 wherein the cellulose textile is further treated with a chemical reagent which assists in optimizing said textile for utilization in subsequent processes or end use applications.

10. The process of claim 9 wherein the chemical reagent is selected from the group consisting of humectants, antibacterial agents, lubricants, dyes, tints, optical brighteners, hand modifiers, antistatic agents, and combinations thereof.

11. A process for decolorizing a cellulose textile bearing oxidized vat dye comprising the steps of:

a) contacting the cellulose textile with an aqueous solution of hydrogen peroxide containing an amount of a hydrogen peroxide catalyst comprising a cupric or stannous metal ion present in an amount of from 0.1 to 2 ppm sufficient to oxidize vat dye in the fabric until said dye is decolorized by oxidation; and b) separating the cellulose textile from the aqueous solution.

* * * * *